US007206427B2

(12) United States Patent
Simidian, II et al.

(10) Patent No.: US 7,206,427 B2
(45) Date of Patent: Apr. 17, 2007

(54) FLAT PANEL SURFACE ARRAY

(75) Inventors: Vahan Simidian, II, Newport Beach, CA (US); Dragoslav Colich, Costa Mesa, CA (US)

(73) Assignee: HPV Technologies LLC, Costa Mesa, CA (US)

( * ) Notice: Subject to any disclaimer, the term of this patent is extended or adjusted under 35 U.S.C. 154(b) by 332 days.

(21) Appl. No.: 10/763,344

(22) Filed: Jan. 23, 2004

(65) Prior Publication Data

US 2004/0213425 A1 Oct. 28, 2004

Related U.S. Application Data

(60) Provisional application No. 60/464,672, filed on Apr. 22, 2003.

(51) Int. Cl.
*H04R 9/06* (2006.01)
*H04R 1/00* (2006.01)

(52) U.S. Cl. ..... 381/335; 381/386

(58) Field of Classification Search ..... 381/82, 381/87, 335–336, 182–186, 386, 345, 351; 181/148, 150, 199
See application file for complete search history.

(56) References Cited

U.S. PATENT DOCUMENTS

| | | | | | |
|---|---|---|---|---|---|
| 3,125,181 | A * | 3/1964 | Pawlowshi | 381/89 |
| 3,778,562 | A * | 12/1973 | Wright | 381/335 |
| 4,399,328 | A | 8/1983 | Franssen | |
| 5,233,664 | A * | 8/1993 | Yanagawa et al. | 381/89 |
| 5,283,836 | A * | 2/1994 | Trufitt | 381/428 |
| 5,749,137 | A * | 5/1998 | Martin | 29/434 |
| 5,758,852 | A * | 6/1998 | Martin | 248/282.1 |
| 5,819,959 | A * | 10/1998 | Martin | 211/118 |
| 2005/0201583 | A1 * | 9/2005 | Colich | 381/335 |

* cited by examiner

*Primary Examiner*—Curtis Kuntz
*Assistant Examiner*—Phylesha L Dabney
(74) *Attorney, Agent, or Firm*—Rutan & Tucker, LLP

(57) ABSTRACT

A surface loudspeaker array uses a plurality of sound sources, such as flat panel or planar magnetic transducers, that are mounted on either a flat or a curved surface to produce a substantially controlled sound dispersion in both the horizontal and vertical planes. The sound sources are mounted in rows and the rows are secured together to allow splaying in the vertical plane to a preset angle defined between rows.

4 Claims, 15 Drawing Sheets

FLAT PANEL SURFACE ARRAY

RELATED APPLICATIONS

This application claims the priority benefit under 35 U.S.C. § 119(e) to U.S. Provisional Patent Application No. 60/464,672, filed on Apr. 22, 2003, which application is hereby incorporated by reference in its entirety.

BACKGROUND OF THE INVENTION

1. Field of the Invention

The present invention generally relates to a loudspeaker having a plurality of flat panel speakers or planar magnetic transducers. More particularly, the present invention relates to a surface loudspeaker array using a plurality of full-range flat panel or planar magnetic transducers that are mounted closely together on either a flat or a curved surface to produce a substantially controlled sound dispersion in both the horizontal and vertical planes.

2. Background of the Invention

Designing audio systems for venues such as stadiums, auditoriums, or theme parks can be difficult. Most companies use traditional speakers arranged in line arrays for such professional applications. The individual speaker elements are typically designed as two- or three-way speaker boxes with direct radiating woofer sections and horn-loaded midrange and tweeter drivers.

Line arrays of speakers are used only infrequently in a straight-line or vertical column configuration, however, because a line array in straight-line configuration has a very narrow vertical sound dispersion. Thus, a line array in straight-line configuration covers a very limited space in the vertical plane. To increase the vertical coverage, the individual speakers in the line arrays are usually curved in the vertical direction, or "vertically splayed," to achieve the desired sound dispersion angle.

The column of speakers is suspended in the air near the area where the sound is desired by various diverse rigging systems. The rigging systems connect the speaker boxes in a compact structure that curves adequately in the vertical plane to provide the desired vertical sound coverage. If the vertical splaying angle between individual speakers is too great, there will be a gap in the sound dispersion, so the vertical splaying angle between line array speaker boxes is usually no more than 5 degrees. A line array of typical speakers would require a vertically curved column of 16 speaker boxes to achieve 80 degrees of vertical coverage, but such an array is both extremely heavy and very expensive. It is therefore not a practical solution for the vast majority of venues.

To keep costs and weight low while still providing vertical sound coverage, the normal solution is to use shorter line arrays with smaller vertical coverage to cover the middle and rear of the venue, and to add separate fill speakers that are used to cover the front of the venue. Unfortunately, this solution produces distorted sound quality in portions of the venue.

Another difficulty with current line array systems particularly affects travelling productions that carry their own audio equipment, such as touring bands that play to large crowds in large venues. An enormous amount of audio equipment is necessary to fill the typical venues at which those travelling productions play with high quality, high volume sound. Thus, the travelling productions must carry with them trailer loads full of speakers, rigging systems, crossovers, computer and electronics equipment, cabling, and the crews who actually set up and remove the equipment. Those crews must spend hours setting up and testing the equipment before each show, and then additional hours after the show removing and storing the equipment.

Another problem with current line array systems involves the rigging systems used to connect the speaker boxes in a structure that curves adequately in the vertical plane to provide the desired vertical sound coverage. Although traditional rigging systems are able to control the vertical splaying angle between individual speakers or rows of speakers, such systems, particularly for larger arrays, can be extremely complicated, difficult to deploy, heavy, and expensive.

An additional problem is that in situations where wider than nominal horizontal sound coverage is desired, simply adding another line array close to the first array is usually not possible due to large phase problems and destructive interference from arrays closely spaced together in the horizontal plane. To avoid those problems, frequently two arrays must be widely separated, which can be extremely difficult or impossible in many situations because of space restrictions.

SUMMARY OF THE INVENTION

Accordingly, a speaker array assembly is desired that can address one or more of these concerns. The speaker array assembly can use a plurality of full-range flat panel or planar magnetic transducers that are mounted closely together on either a flat or a curved surface to produce a substantially controlled sound dispersion in both the horizontal and vertical planes.

One embodiment of the present invention provides a surface loudspeaker array that enables sound dispersion in both the horizontal and vertical planes for very high quality, high volume sound. In one preferred embodiment, the surface array is particularly adapted for professional audio applications, particularly in large venues. The surface array preferably uses flat panel speakers or planar magnetic transducers that are mounted closely together on either a flat or a curved surface.

One aspect of an embodiment of the present invention also provides a method for quickly and easily deploying the surface array. A surface array can be constructed of a plurality of vertically splayable racks, each of which includes a plurality of flat panel speakers or planar magnetic transducers that are horizontally splayed to a pre-set angle. The vertical splay angle between each adjacent pair of vertically splayable racks can be set individually. In typical use, the surface array is lifted into the air near the target audience location. A grid serves as a hanger for the surface array, which is lifted from two or more suspension points on the grid, which is itself attached to the top of the surface array. The grid can be attached to the surface array in either of two positions. In one grid attachment position, the grid provides a suspension point well in front of the center of gravity of the surface array. In other grid attachment position, the grid provides a suspension point well behind the center of gravity of the surface array. Thus, the grid can be attached in either position, depending on the way the surface array is intended to be deployed.

As the surface array is lifted for deployment, the individual vertically splayable racks automatically splay apart to a pre-set vertical splay angle. A tensioning device, such as a strap, can be attached from a point of the grid to a bar at the bottom of the surface array. Tightening the tension device allows each of the vertically splayable racks to splay to approximately the desired, pre-set splay angle. Because both the horizontal and vertical splay angles between the individual flat panel speakers or planar magnetic transducers are pre-set, the surface array of an arrangement configured in accordance with certain features, aspects and advantages of the present invention is able to control sound dispersion in both vertical and horizontal planes. Using at least one embodiment, it is possible to achieve any overall horizontal or vertical dispersion angle by using an adequate number of flat panel speakers or planar magnetic transducers in a row for horizontal dispersion, and an adequate number of rows for vertical dispersion.

In one embodiment, the vertical splaying angle between the vertically splayable racks of flat panel speakers or planar magnetic transducers can be adjusted up to ten (10) degrees without losing uniform vertical coverage. Thus, with only eight (8) rows of speakers, this embodiment can achieve up to about 80 degrees of substantially uniform vertical coverage.

Embodiments also provide substantial control over the sound dispersion. Thus, the surface array can provide for very rapid sound attenuation at its ends (almost zero degrees of vertical dispersion), and when the surface loudspeaker array is vertically splayed such that the bottom row of flat panel speakers or planar magnetic transducers is facing directly downward, it achieves a very sharp transition, approximately a foot-wide area, between loud and soft sound. When the surface array is hung high in the air in this manner, sound projection from the surface array is loud in front of the surface loudspeaker array and directly beneath the bottom row of the array (the one facing directly downward), but the sound level drops abruptly upon passing behind the array such that one is no longer directly beneath the bottom row of the surface array. Thus, the array forms a "sound curtain," because the area behind the surface array is in effect isolated from the volume produced by the surface array. In at least one embodiment, the surface array produces full-range sound from about 30 Hz to about 20 kHz.

Acoustic blankets can also be placed across portions of the surface array for sound control. Planar magnetic transducers are characteristically dipole, which means that, unlike typical speakers, they radiate the same sound both to the front and to the rear. Thus, in one embodiment of the present invention, acoustic blankets are placed across a portion of the surface array, and they absorb the waves emanating from that portion of the array and significantly reduce or prevent sound from propagating in that direction. If the back face of the surface array is substantially covered, the dispersion pattern of the surface array is transformed into a cardioid. In a cardioid dispersion pattern, the radiation pattern in front of the speakers is the same as a dipole dispersion pattern, but the radiation pattern behind the speakers is absorbed almost completely. This absorption reduces noise on stage, and therefore helps to resolve acoustic feedback problems, thus providing the sound designer with more control and flexibility in design. In another embodiment of the present invention, portions of the surface array can be suitably enclosed.

A surface array can be constructed using any number of vertically splayable racks of flat panel speakers or planar magnetic transducers. If a sufficient number of vertically splayable racks is used, the surface array can equal or exceed the Sound Pressure Level (SPL) created by current line arrays.

An aspect of an embodiment of the present invention involves a surface loudspeaker array comprising a plurality of vertically-splayable speaker racks, wherein each the vertically-splayable speaker rack comprises a plurality of planar magnetic transducers or flat panel speakers. A first attachment device engages at least one of the plurality of vertically-splayable speaker racks in a forward or reversed position. The first attachment device comprises a plurality of suspension points from which the surface loudspeaker array can be suspended. A second attachment device engages another one of the plurality of vertically-splayable speaker racks. A tensioning device connects the first attachment device and the second attachment device. A sound dampening device is attached to a back side of the surface loudspeaker array. A plurality of hardware secures the plurality of vertically-splayable speaker racks to one another in a serial manner such that when the vertically-splayable speaker racks are connected using the hardware, the vertically-splayable speaker racks are splayed apart to a pre-set angle when the surface loudspeaker array is in an elevated state.

Another aspect of an embodiment of the present invention involves a surface loudspeaker array comprising a plurality of vertically-splayable speaker racks that are connected together vertically in a serial manner. Each of said vertically-splayable speaker racks includes a plurality of planar magnetic transducers or flat panel speakers.

Yet another aspect of an embodiment of the present invention involves a surface loudspeaker array kit. The kit comprises: a plurality of vertically-splayable speaker racks, wherein each said vertically-splayable speaker rack comprises a plurality of planar magnetic transducers or flat panel speakers; a plurality of hardware, said hardware adapted to attach said vertically-splayable speaker racks to one another, said hardware comprising means for pre-setting a splaying angle; a first attachment device, said first attachment device adapted to engage at least one of said vertically-splayable speaker racks in a forward or reversed orientation, said first attachment device comprising a plurality of suspension points from which said surface loudspeaker array can be suspended; a second attachment device, said second attachment device adapted to engage at least one of said vertically-splayable speaker racks; and a tensioning device, said tensioning device adapted to engage said first attachment device and said second attachment device.

One other aspect of an embodiment of the present invention involves a method for deploying a surface loudspeaker array comprising a plurality of connected vertically-splayable speaker racks. The method comprises attaching a first attachment device to a surface array made up of a plurality of vertically-splayable speaker racks, lifting said surface array using suspension points on said first attachment device, and attaching a plurality of additional vertically-splayable speaker racks to increase the size of said surface array.

A further aspect of an embodiment of the present invention involves a method of assembling and deploying a surface loudspeaker array comprising a plurality of rows of planar magnetic transducers or flat panel speakers. The method comprises providing a first row of planar magnetic transducers or flat panel speakers, connecting a grid to a first surface of the first row of planar magnetic transducers or flat panel speakers, raising the first row of planar magnetic transducers or flat panel speakers, providing a second row of planar magnetic transducers or flat panel speakers, connecting a first surface of the second row of planar magnetic transducers or flat panel speakers to a second surface of the first row of planar magnetic transducers or flat panel speakers, setting a preselected splay angle between the first row and the second row of planar magnetic transducers or flat panel speakers and raising the first row and the second row of planar magnetic transducers or flat panel speakers such that the first row and the second row of planar magnetic transducers or flat panel speakers can splay to the preselected splay angle.

BRIEF DESCRIPTION OF THE DRAWINGS

These and other features, aspects, and advantages of an embodiment of the present invention will now be described with reference to drawings of one or more preferred embodiments, which embodiments are intended to illustrate and not to limit the present invention. The drawings comprise 15 drawings.

DETAILED DESCRIPTION OF THE PREFERRED EMBODIMENT

Figure 1A:
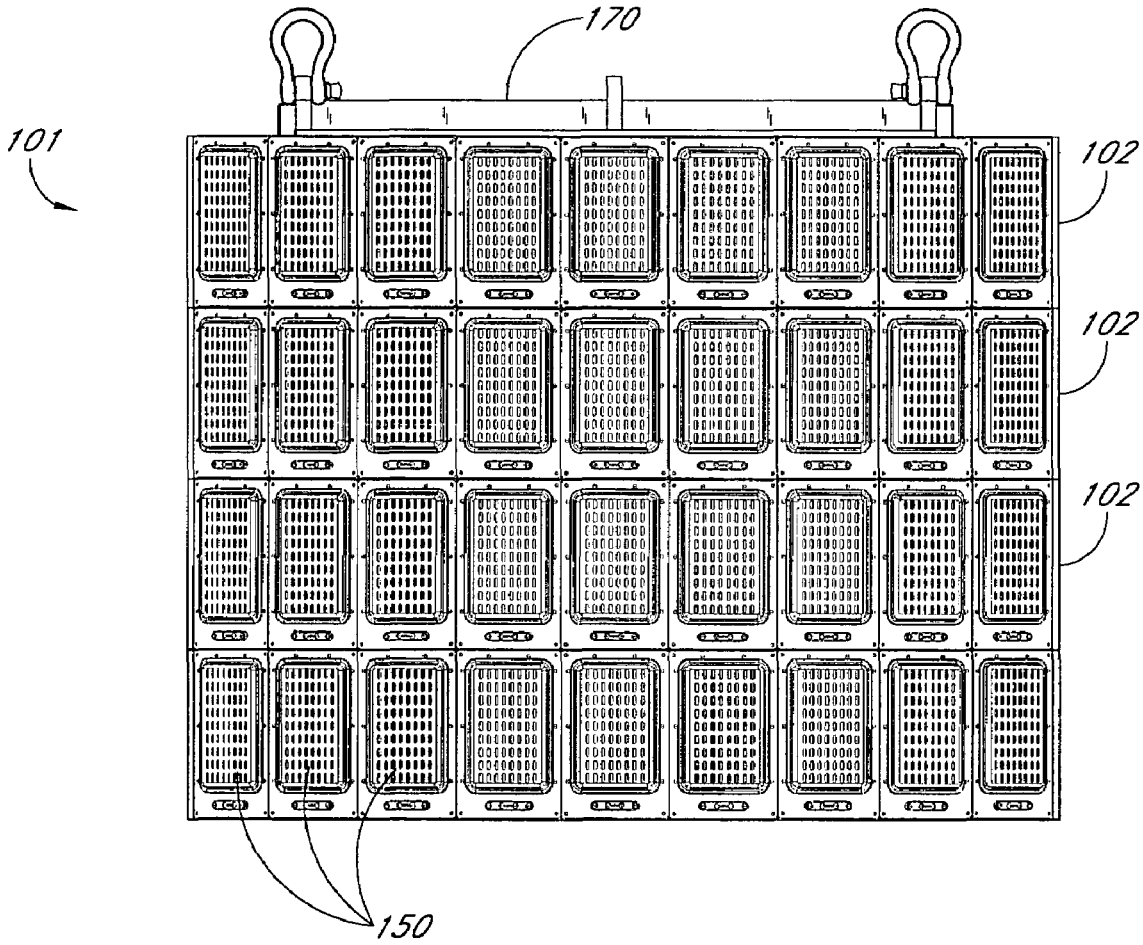
FIG. 1A illustrates in a side elevation the front of a surface array composed of multiple vertically-splayable racks suspended in the air with its vertically-splayable racks in a generally non-vertically splayed position.
Figure 1B:
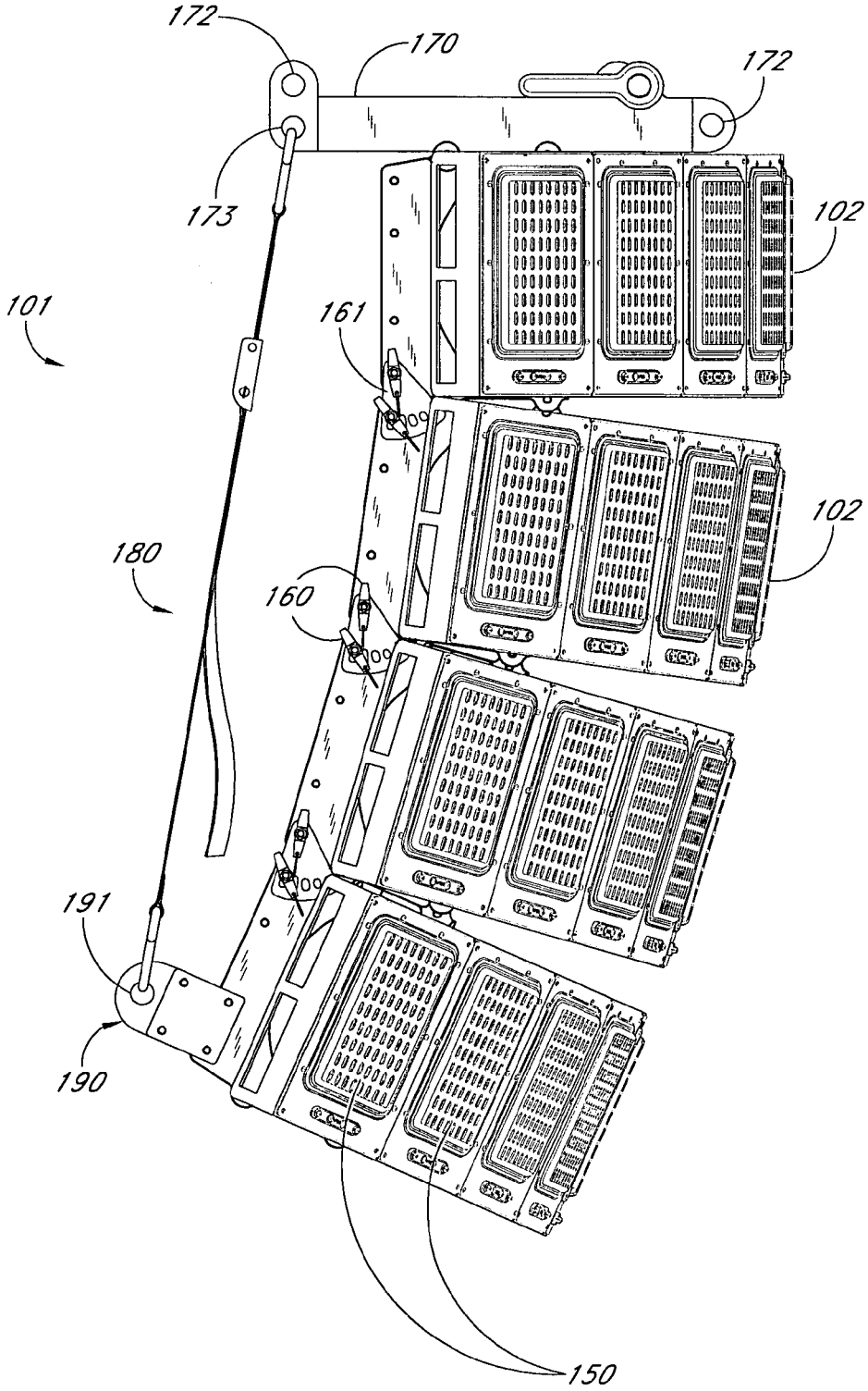
FIG. 1B illustrates in a side elevation the side of a surface array suspended in the air with its vertically-splayable racks in vertically splayed position, and with a tension strap extending from a grid attached to the top vertically-splayable rack in reversed position to a bar attached to the bottom vertically-splayable rack of the surface array.

With reference initially to FIGS. 1A and 1B, a surface loudspeaker array 101 arranged and configured in accordance with certain features, aspects and advantages of the present invention is shown. In one embodiment of the invention, the surface loudspeaker array 101 is advantageously constructed of a plurality of vertically-splayable racks 102 of flat panel speakers or planar magnetic transducers 150 (hereinafter PMT 150), as shown. In another embodiment not shown, the surface loudspeaker array 101 is advantageously constructed of a plurality of horizontally-splayable racks of flat panel speakers or PMT 150. In yet another embodiment not shown, the surface loudspeaker array 101 is advantageously constructed of a non-splayable grid of flat panel speakers or PMT 150. In the illustrated arrangement, four racks 102 define the array 101. Other numbers of racks 102 also can be used to define an array of a desired configuration. For instance, in one particularly preferred arrangement, eight racks 102 each containing nine PMT 150 are combined into an array 101. The number of racks 102 that can be connected serially number as many as 32 or more.

The PMT 150 should be closely matched one PMT to another within the array 101 for performance characteristics. Matched, as used herein, means that the overall difference between the absolute high and the absolute low of the specified characteristics one PMT to another within the surface array differ by no more than the designated amount. It is preferable that the frequency responses of the PMT 150 should match one PMT to another within about 5 dB. More preferably, the frequency responses should match one PMT to another to within about 2 dB. Even more preferably, the frequency responses should match one PMT to another within 1 dB. In addition, it is preferable that the resonant frequencies of the PMT 150 match one PMT to another within about 30%. More preferably, the resonant frequencies should match one PMT to another within about 15%. Even more preferably, the resonant frequencies should match one PMT to another within about 10%. If the frequency responses and resonant frequencies of the PMT 150 are not matched properly, overall sound performance suffers. The PMT 150 themselves could be of shapes other than rectangular, including but not limited to circular, triangular, pentagonal, hexagonal, heptagonal, or octagonal.

With reference to FIG. 1B, the top vertically-splayable rack 102 preferably is attached to a grid 170, which includes a plurality of suspension points 172. In one embodiment of the invention, a bar 190 is attached to one of the vertically-splayable racks 102, and a tension strap 180 is attached to the grid 170 and the bar 190, as shown in FIG. 1B. Although the bar 190 is shown attached to the bottom vertically-splayable rack 102 in FIG. 1B, in other embodiments, the bar 190 can be attached to other vertically-splayable racks 102. In one embodiment of the invention, the vertically-splayable racks 102 are connected together using cams 161 and rack connecting hardware 160. The rack connecting hardware 160 may consist of quick-release pins, bolts, or other suitable hardware.

Figure 2:
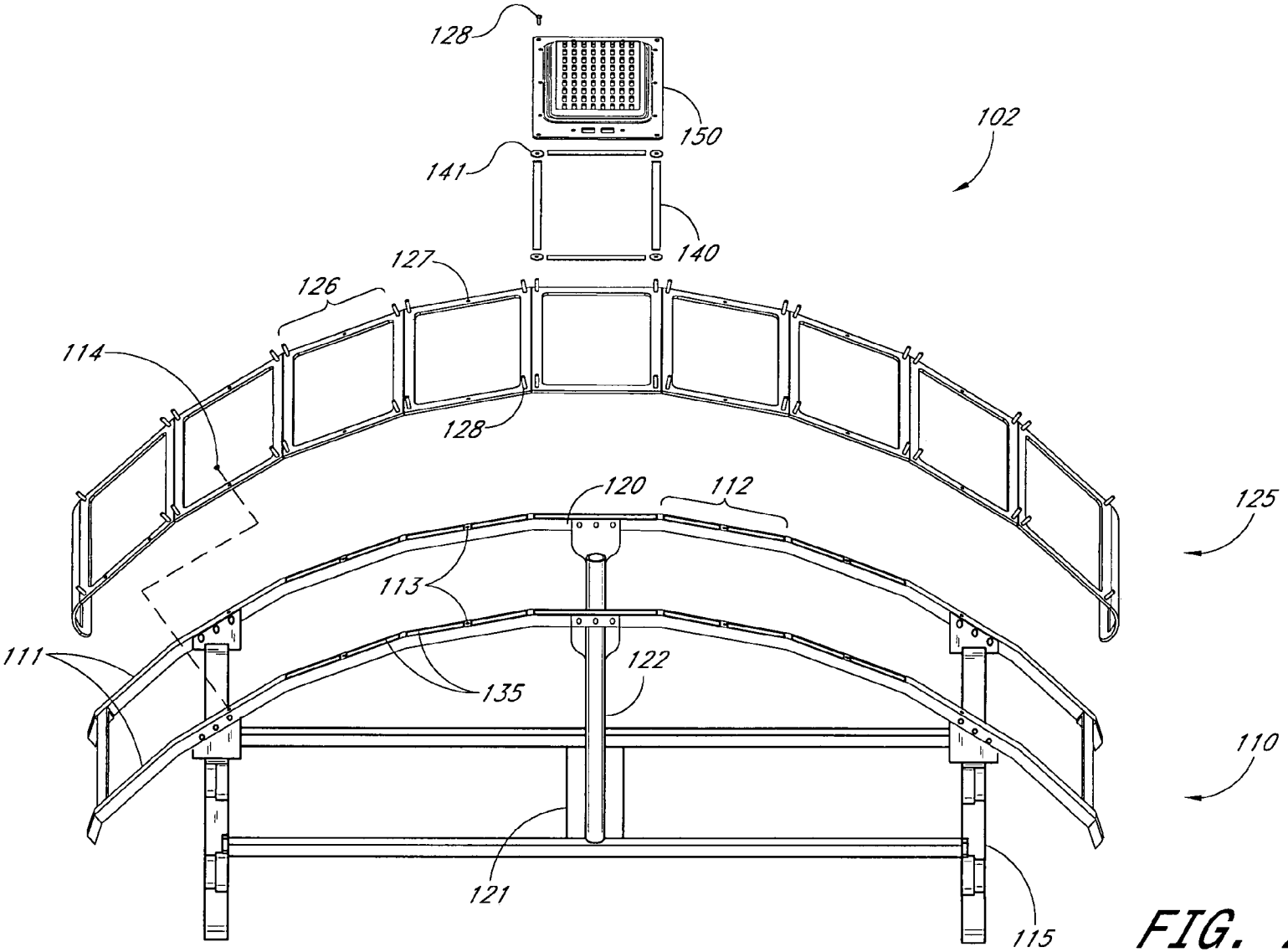
FIG. 2 illustrates in an exploded view pieces of a vertically-splayable speaker rack, including a rib, a baffle, and a single representative planar magnetic transducer or flat panel speaker.

With reference now to FIG. 2, in one embodiment each vertically-splayable rack 102 is advantageously constructed of a rib 110, a baffle 125, and a plurality of PMT 150. The rib 110 serves as the structural framework for the vertically-splayable rack 102. The baffle 125 generally insulates the PMT 150 from one another. In one preferred embodiment, the rib 110 and the baffle 125 are advantageously made of aluminum because it is strong yet lightweight, but other materials are acceptable in other embodiments. The PMT 150 produce the desired sound. In one embodiment, nine PMT 150 are mounted to each rack 102. Other numbers of planar transducers 150 also can be used.

Figure 3A:
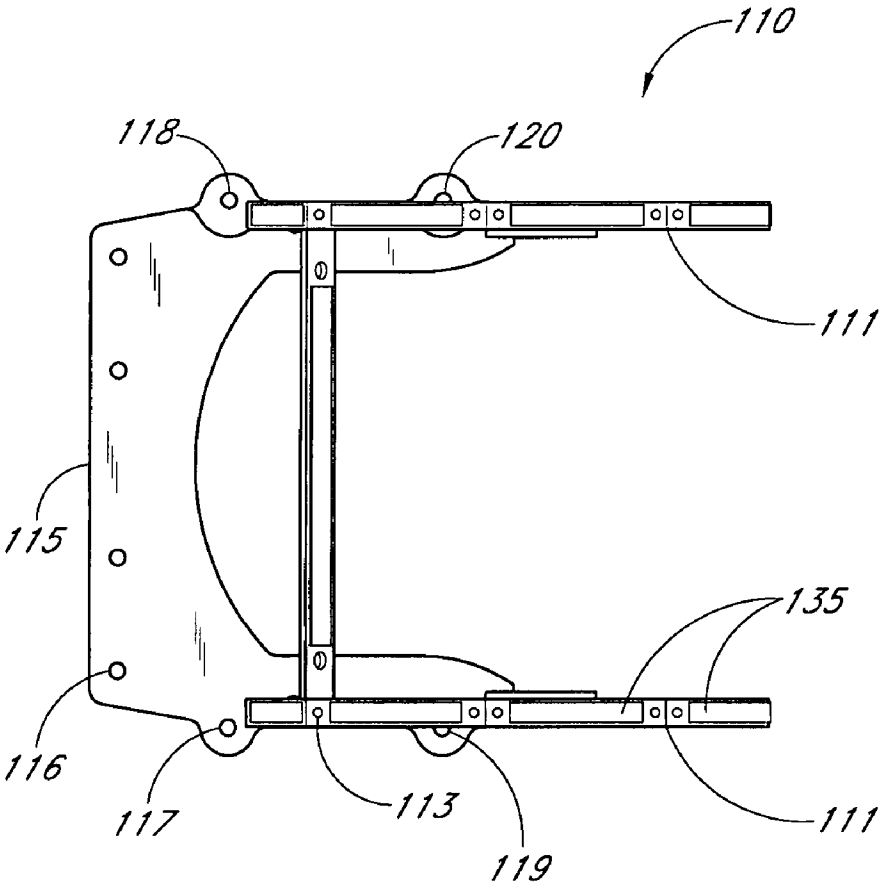
FIG. 3A illustrates in a side elevation the end of a rib.
Figure 3B:
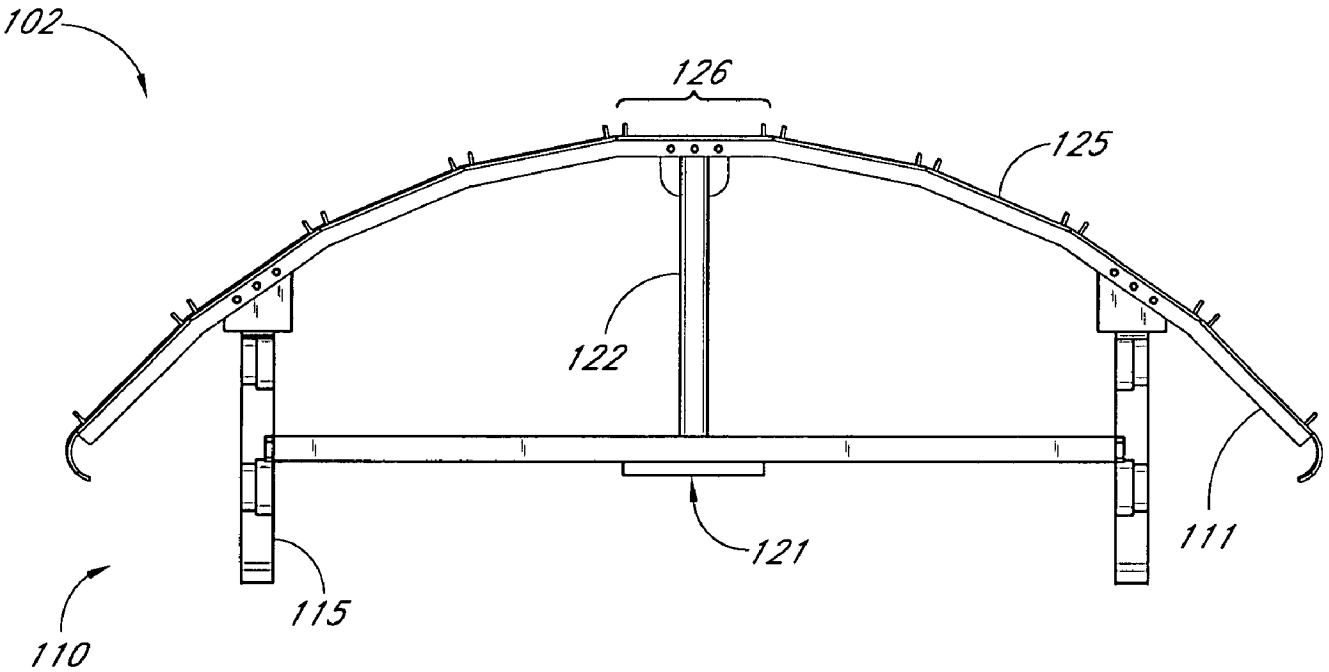
FIG. 3B illustrates in a side elevation the top of a rib and baffle.

With reference to FIGS. 2 and 3A, each rib 110 advantageously includes a plurality of mounting members 111. As shown, the mounting members 111 preferably define the general shape of the forward face of the vertically-splayable rack 102, particularly the horizontal splaying angle (as viewed in a horizontal plane) between individual PMT 150. With reference to FIG. 2, in one embodiment, the mounting members 111 desirably form segments of an arc-like shape and include a plurality of flattened support positions 112. In various alternative embodiments, the mounting members 111 could describe an arc encompassing any number of degrees from the minimum needed for one flattened support position 112 to three-hundred-sixty (a complete circle), the mounting members 111 could include any number of flattened support positions 112

With reference to FIG. 3A, in one embodiment, the rib 110 also advantageously includes a plurality of end members 115. As illustrated in FIG. 3A, each end member 115 advantageously includes a plurality of rib end holes 116, a pivot hole 117, a recessed pivot hole 118, a locking hole 119, and a recessed locking hole 120. In some embodiments, differing numbers of rib end holes 116 at adjusted locations can be implemented.

With reference to FIG. 2, the baffles 125 preferably are secured between the mounting members 111 and the PMT 150. The baffles 125 generally insulate each individual PMT 150 from vibrations caused by the other PMT 150 in the same vertically-splayable rack 102. In other words, as sound is generated by any of the sound sources (e.g., PMT 150), the sound source vibrates and the baffles substantially isolate (e.g., reduce the transference) of vibrational energy from the rack 102.

Figure 3C:
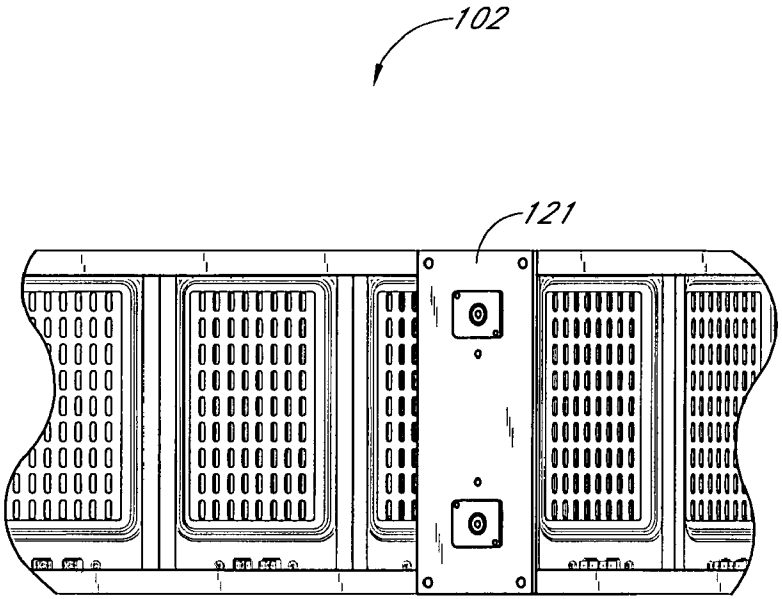
FIG. 3C illustrates in a sectional view the back of a rib and baffle with flat panel speakers or planar magnetic transducers installed.
Figure 3D:
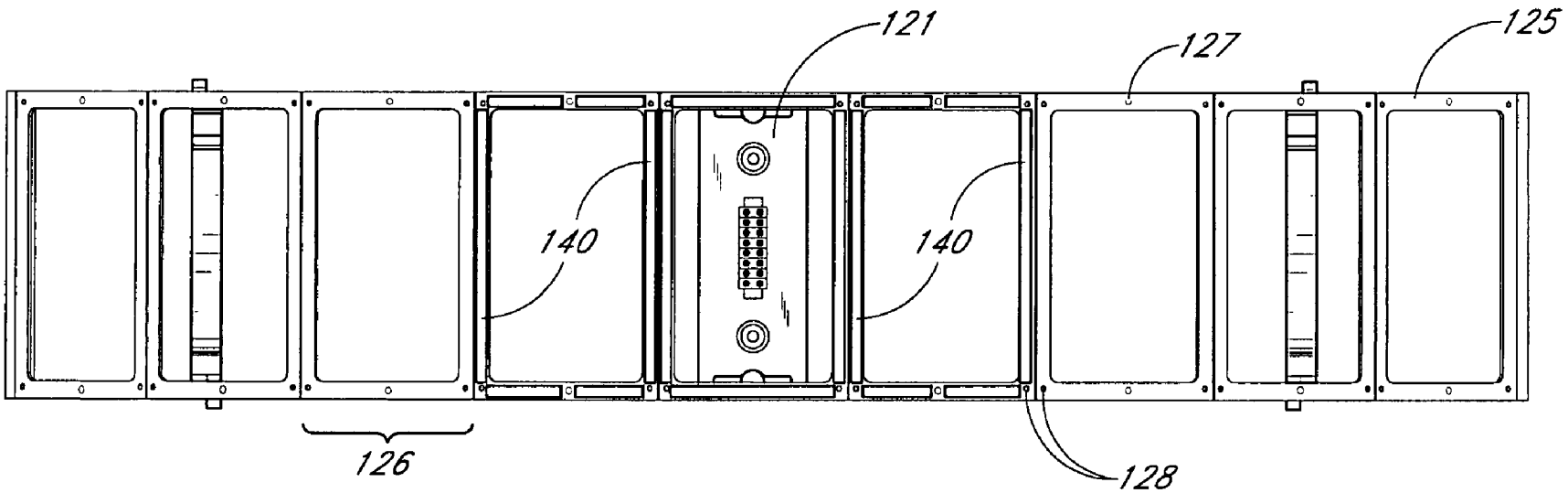
FIG. 3D illustrates in a side elevation the front of a rib and baffle of a vertically-splayable rack.

With reference to FIGS. 2 and 3A, the mounting members 111 advantageously include a plurality of baffle attachment holes 113. In one embodiment, the baffle 125 also advantageously includes rib attachment holes 127. In addition, as shown in FIG. 3D, for instance, PMT mounting hardware 128 can be connected to the baffle 125. Baffle attachment hardware 114 is inserted through the rib attachment holes 127 and baffle attachment holes 113 to attach the baffle 125 to mounting members 111 of the rib 110, as illustrated in FIG. 2. Other suitable methods of connecting the baffles 125 to the ribs 110 also can be used.

As explained above, the baffle 125 dampens vibrations from the individual PMT 150. Thus, in one embodiment illustrated in FIGS. 2 and 3A, the rib 110 and the baffle 125 are separated by baffle insulating strips 135 when attached together. In one embodiment, the baffle insulating strips 135 are advantageously made of foam and of generally rectangular shape, but in other embodiments (not illustrated) the baffle insulating strips 135 may be made of other materials and may be of other shapes so long as the baffle insulator (which need not be a strip) effectively reduces the amount of vibrational energy transmitted to the ribs 110. Although not illustrated, the rib 110 and the baffle 125, when attached, preferably are also separated by cushion spacers 136, which are disposed about the baffle attachment hardware 114 between the rib 110 and the baffle 125. In a preferred embodiment, the cushion spacers 136 are of a suitable thickness, such that when the rib 110 and the baffle 125 are attached using the baffle attachment hardware 114, the baffle insulating strips 135 are compressed to a height such that the rib and baffle are slightly spaced apart from each other. In this configuration, the compression helps to ensure contact among the baffle 125, the baffle insulating strips 135 and the rib 110.

One aspect of an embodiment of the present invention allows for easy electrical connection of the PMT 150 that make up the surface array 101. In one embodiment, the rib 110 advantageously includes a plurality of electrical connections 121 (see FIG. 3C) and a plurality of electrical connector tunnels 122 (see FIGS. 2 and 3B through 3D). The electrical connections 121 preferably are placed at the back of the rib 110, where they are easily accessible from behind the surface array 101. In the embodiment illustrated, the electrical connector tunnels 122 run from near the electrical connections 121 to a point near the center of the forward face of the vertically-splayable rack 102. By running electrical wires from the PMT 150 through the electrical connector tunnels 122 to the electrical connections 121, the illustrated embodiment of the current invention greatly reduces or eliminates tangling of electrical wires from adjacent vertically-splayable racks 102 within the surface array 101. This construction also advantageously allows for easy electrical connection of racks 102 in the array 101 using jumper cables (not shown).

The baffle 125 can be shaped substantially similar to the ribs 110 to which the baffle 125 is attached. In the illustrated embodiment, the baffle 125 is generally arc-like and includes a plurality of flattened PMT mounting positions 126, to which the individual PMT 150 will be attached. In the embodiment illustrated in FIGS. 2, 3B, and 3D, the baffle 125 includes one row of flattened PMT mounting positions 126. The illustrated baffle 125 is also slightly angled between each pair of PMT flattened mounting positions 126. In other arrangements, the baffle 125 can be angled between each mounting position 126, between every third mounting position 126 or the like. With reference to FIGS. 2 and 3D, the individual PMT flattened mounting positions 126 preferably are of rectangular shape.

In various alternative embodiments (not shown), the baffle 125 could include more than one row of PMT flattened mounting positions 126; the slight angle or "horizontal splay" between each pair of PMT flattened mounting positions 126 could range from about zero (no horizontal splay) to approximately fifteen (15) degrees; the PMT flattened mounting positions 126 could be of shapes other than rectangular, including but not limited to circular, triangular, pentagonal, hexagonal, heptagonal, or octagonal; the baffle 125 could generally describe an arc encompassing any number of degrees from the minimum needed for one flattened PMT mounting position 126 to about 360° (a complete circle); and the baffle 125 could include any number of flattened PMT mounting positions 126. In one particularly preferred arrangement, the horizontal dispersion angle is approximately 90°. In another preferred arrangement, the horizontal dispersion angle is approximately 60°.

In the illustrated arrangement, the PMT mounting hardware 128 is used to attach the PMT 150 to the baffle 125. In the embodiment illustrated in FIGS. 2 and 3D, the PMT mounting hardware 128 is disposed in the four corners of each flattened PMT mounting position 126 on the baffle 125. The PMT mounting hardware 128 may be disposed in different positions around the flattened PMT mounting positions 126, particularly when the flattened PMT mounting positions 126 are of shapes other than rectangular. Furthermore, the PMT mounting hardware can be connected to the PMT 150 or can be passed through the PMT 150, the baffle 125 and the rib 110 in some embodiments.

In one embodiment, the PMT 150 are preferably attached to the baffle 125 using the PMT mounting hardware 128, as illustrated in FIG. 2. In one preferred embodiment, the PMT 150 are separated from the baffle 125 by transducer insulating strips 140, as illustrated in FIGS. 2 and 3D, and transducer spacers 141, as illustrated in FIG. 2. In one embodiment illustrated, the transducer insulating strips 140 are advantageously made of foam and of generally rectangular shape, but it will be understood that in other embodiments (not illustrated) the transducer insulating strips 140 may be made of other materials and may be of generally different shapes (and may not be strips in shape). In one preferred embodiment, the transducer spacers 141 are disposed about the PMT mounting hardware 128 between the baffle 125 and the PMT 150. In a preferred embodiment, the transducer spacers 141 are advantageously of a pre-determined thickness, such that when the baffle 125 and the PMT 150 are attached using the PMT attachment hardware 128, the transducer insulating strips 140 are compressed to a suitable height. Again, the compression ensures contact between the respective components.

Figure 4:
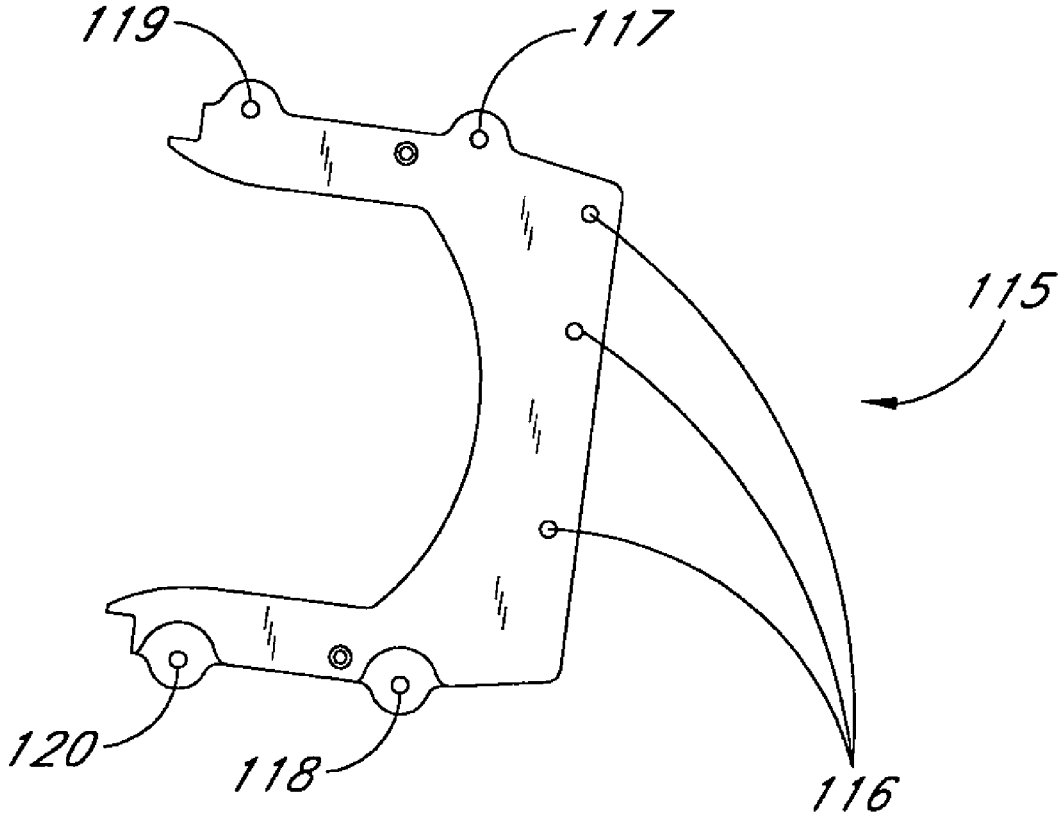
FIG. 4 illustrates in a side elevation an end piece of a vertically-splayable rack.
Figure 5A:
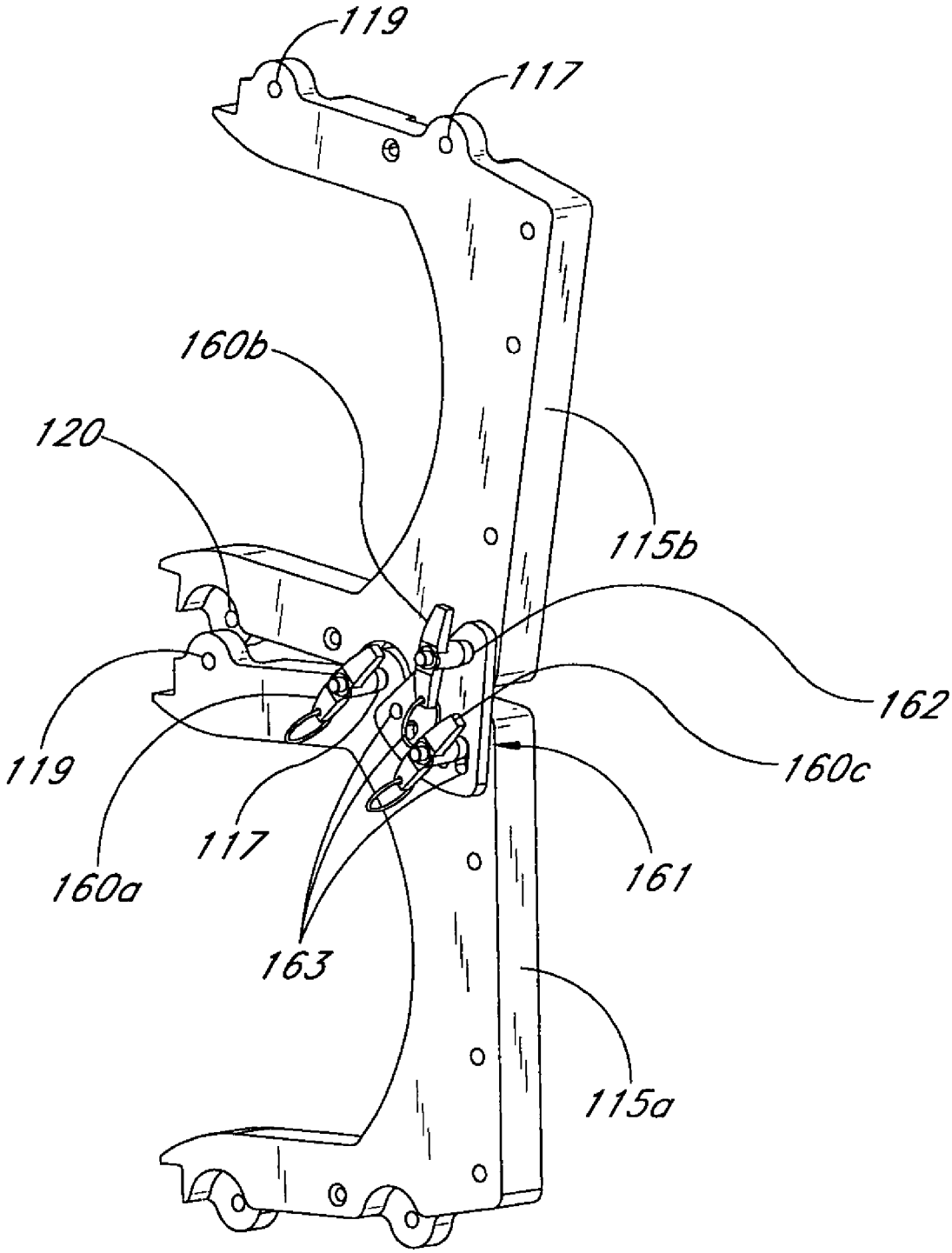
FIG. 5A illustrates in an isometric view adjacent end pieces of two vertically-splayable racks, a cam, and attachment hardware.
Figure 5B:
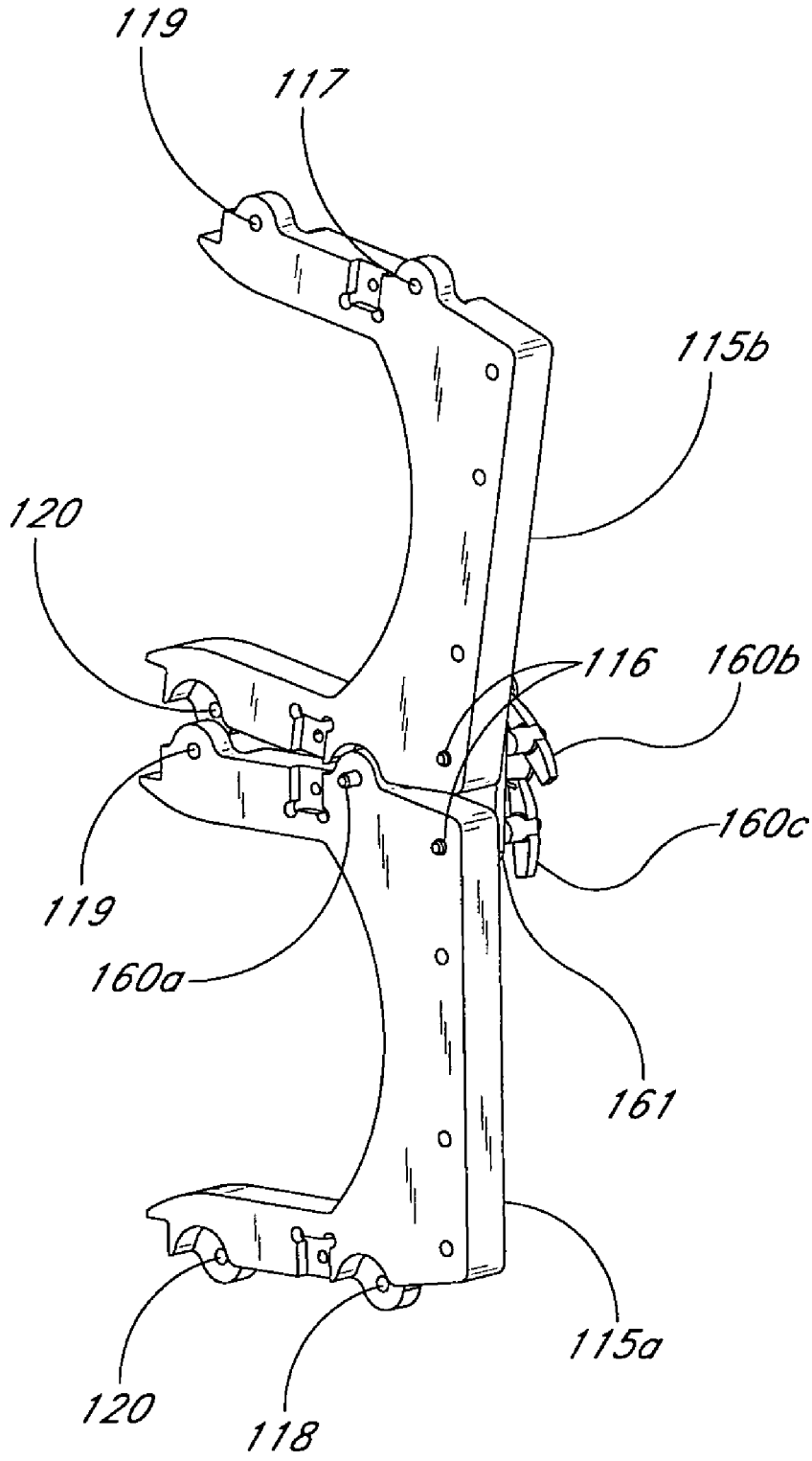
FIG. 5B illustrates in an isometric view adjacent end pieces of two vertically-splayable racks, a cam, and attachment hardware.

Although it is possible to construct a surface array 101 using only a single vertically-splayable rack 102, it is generally preferable to construct a surface array 101 from a plurality of vertically-splayable racks 102. FIGS. 5A and 5B illustrate one embodiment of the invention, in which two adjacent vertically-splayable racks 102 can be advantageously connected in predetermined positions using a plurality of rack connecting hardware 160 and end member 115, such as those illustrated in FIG. 4. Adjacent vertically-splayable racks 102 advantageously can be connected in either a non-splayable locked position or a splayable unlocked position.

In one embodiment of the invention (similar to that shown in FIG. 6), two adjacent vertically-splayable racks 102*a* and 102*b*, represented in FIGS. 5A and 5B by end members 115*a* and 115*b*,can be advantageously connected in a non-splayable locked position using suitable rack connecting hardware 160. To connect two adjacent vertically-splayable racks 102*a* and 102*b* in non-splayable locked position, the pivot hole 117 of the end member 115*a* of the first vertically-splayable rack 102*a* is aligned with the recessed pivot hole 118 of the end member 115*b* of the second vertically-splayable rack 102*b*. A first piece of rack connecting hardware 160*a* is placed through the pivot hole 117 of the first end member 115*a* and the recessed pivot hole 118 of the second end member 115*b*. The locking hole 119 of the first end member 115*a* is also aligned with recessed locking hole 120 of the second end member 115*b*, and a second piece of rack connecting hardware 160*b* is placed through the locking hole 119 of the first end member 115*a* and the recessed locking hole 120 of the second end member 115*b*. Thus, when the surface array 101 is lifted, the individual end members 115*a* and 115*b* are held firmly in place, and the vertically-splayable racks 102 are not able to pivot vertically in relation to one another.

Adjacent vertically-splayable racks 102 advantageously can be connected in splayable unlocked position using a plurality of cams 161 and a plurality of rack connecting hardware 160. A feature of the embodiment of the invention illustrated in FIGS. 5A and 5B is that, when so attached, the individual vertically-splayable racks 102 automatically splay apart no farther than a pre-set splay angle. This is accomplished using a cam 161 (see FIG. 5A), which advantageously includes a cam pivot hole 162 and a plurality of splay angle control slots 163. The splay angle control slots 163 are of differing lengths. Those differing lengths correspond to differing desired angles of vertical splay between the attached vertically splayable racks 102. The cam 160 is illustrated as wedge-shaped and including five splay angle control slots 163, but the cam 161 may be of other shapes and have differing numbers of splay angle control slots 163.

FIGS. 5A and 5B illustrate how two vertically-splayable racks 102*a* and 102*b* can be connected in splayable unlocked position, using end members 115*a* and 115*b* to represent vertically-splayable racks 102*a* and 102*b*. The pivot hole 117 of the first vertically-splayable rack 102*a*, represented by end member 115*a*,is aligned with the recessed pivot hole 120 of the second vertically-splayable rack 102*b*, represented by end member 115*b*. A first piece of rack connecting hardware 160*a* is placed through the pivot hole 117 of the end member 115*a* and through the recessed pivot hole 118 of the second end member 115*b*. The locking hole 119 of the first end member 115*a* can be aligned with the recessed locking hole 120 of the second end member 115*b*, but no piece of rack connecting hardware 160 is placed through the locking hole 119 of the first end member 115*a* or through the recessed locking hole 120 of the second end member 115*b*. Instead, a cam 161 is placed adjacent to the two end members 115*a* and 115*b*. A second piece of connecting hardware 106*b* is inserted through the cam pivot hole 162 of the cam 161 and also through the rib end hole 116 of the second end member 115*b*. The cam 161, however, is capable of pivotal movement relative to the second piece of connecting hardware 160*b*. A third piece of rack connecting hardware 160*c* is also inserted through one of the splay angle control slots 163 of the cam 161 and through the rib end hole 116 of the first end member 115*a*. The desired splay angle control slot 163 that matches the desired vertical splay angle can be aligned with the rib end hole 116 by pivoting the cam 161 prior to inserting the third piece of rack connecting hardware 160*c*. For example, in the embodiment of the cam 161 illustrated, the different splay angle control slots 163 correspond to vertical splay angles of about 0°, about 2.5°, about 5°, about 7.5°, and about 10°. In one particularly preferred embodiment comprising eight racks, the overall vertical dispersion resulting from a joining of the eight racks 102 is between approximately 0° and approximately 80°. In another particularly preferred embodiment comprising four racks, the overall vertical dispersion is between approximately 0° and approximately 40°. Advantageously, the individual rows can be splayed different amounts from the other rows. For example, one row can be splayed about 2.5° and the next row can be splayed about 10°

Figure 6:
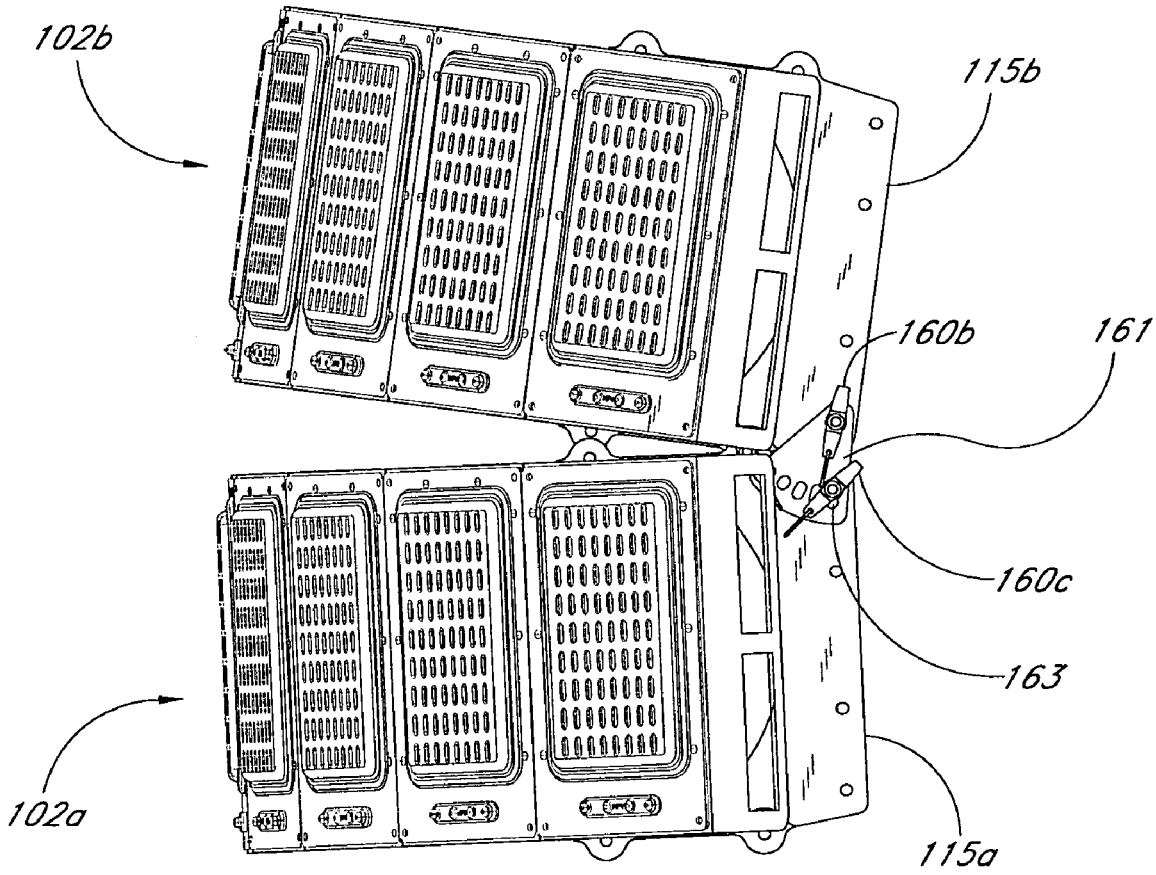
FIG. 6 illustrates in a side elevation two adjacent vertically-splayable racks in vertically-splayed position, a cam, and attachment hardware.

Once two vertically-splayable racks 102*a* and 102*b* have been connected together in vertically-splayable position, they will automatically splay apart to the pre-set angle. FIGS. 5A, 5B, and 6 represent two vertically-splayable racks 102*a* and 102*b* in a vertically splayed position. When the surface array 101 is lifted, the vertically-splayable racks 102*a*, 102*b* pivot about the first piece of rack connecting hardware 160*a*, visible in FIGS. 5A and 5B, which is inserted through the pivot hole 117 of the first vertically-splayable rack 102*a* and through the recessed pivot hole 118 of the second vertically-splayable rack 102*b*. As the two vertically-splayable racks 102*a* and 102*b* pivot about the first piece of connecting hardware 160*a*, the second piece of connecting hardware 160*b*, which was inserted through the cam pivot hole 162 of the cam 161 and through the rib end hole 116 of the second vertically-splayable rack 102*b*, is automatically moved closer to the third piece of rack connecting hardware 160*c*, which was inserted through one of splay angle control slots 163 of the cam 161 and through the rib end hole 116 of the first vertically-splayable rack 102*a*. As the second piece of rack connecting hardware 106*b* moves closer to the third piece of rack connecting hardware 160*c*, the third piece of rack connecting hardware 160*c* is automatically moved to one end of one of the splay angle control slots 163, at which point the third piece of rack connecting hardware 160*c* can move no farther. Thus, the two vertically-splayable racks 102*a* and 102*b* can vertically splay to the desired pre-set vertical splay angle, but no farther apart, similar to the arrangement shown in FIG. 6.

Another feature of the embodiment of the invention illustrated in FIGS. 5A, 5B, and 6 is that the rack connecting hardware 160 can be advantageously composed of a plurality of quick-release locking pins. Thus, a surface array 101 can be constructed quickly of individual vertically-splayable racks 102, and it also can be taken apart quickly. The pieces of rack connecting hardware 160 could also be bolts, screws or other suitable mechanical components.

Figure 7A:
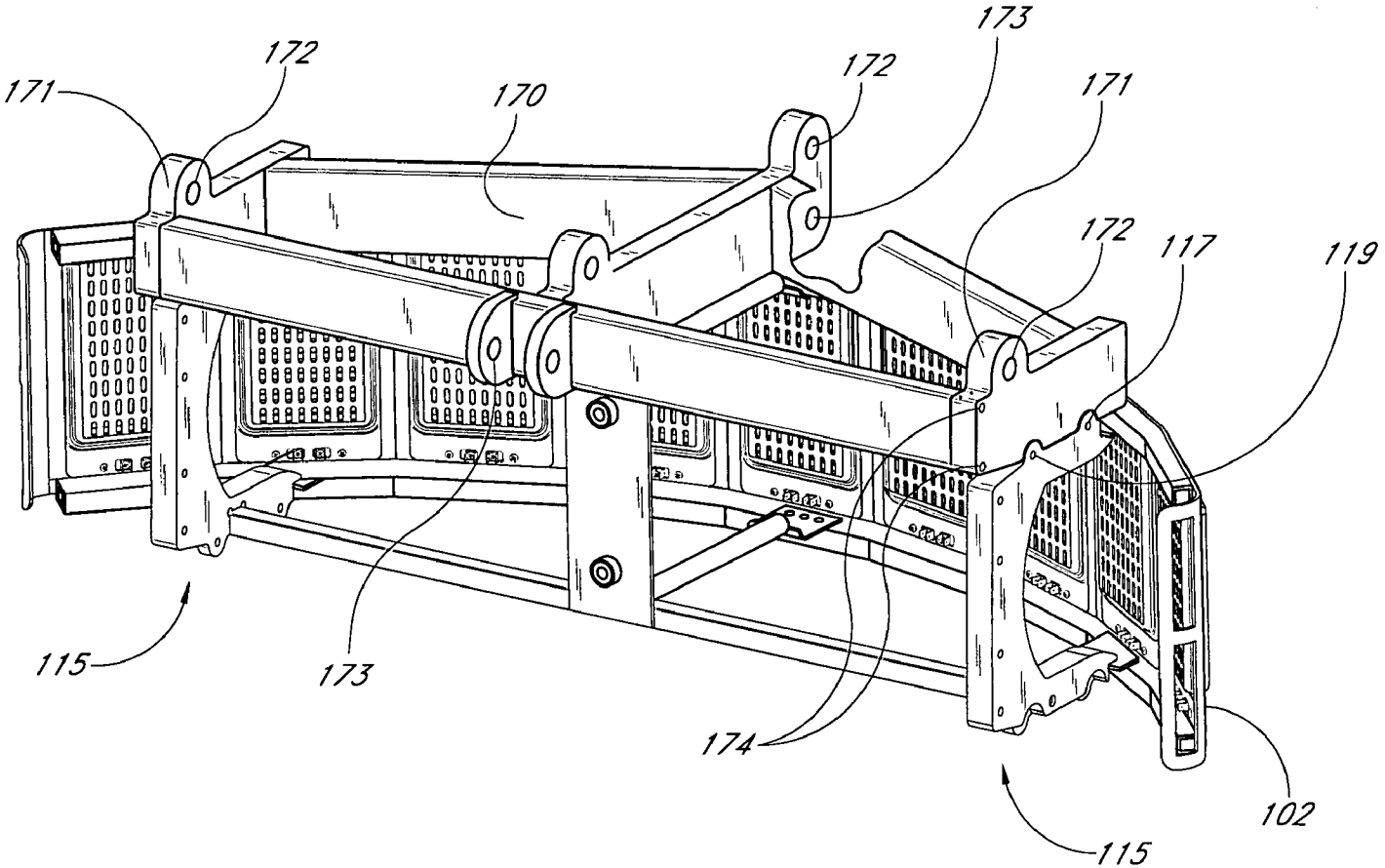
FIG. 7A illustrates in an isometric view a vertically-splayable rack attached to a grid in forward position.
Figure 7B:
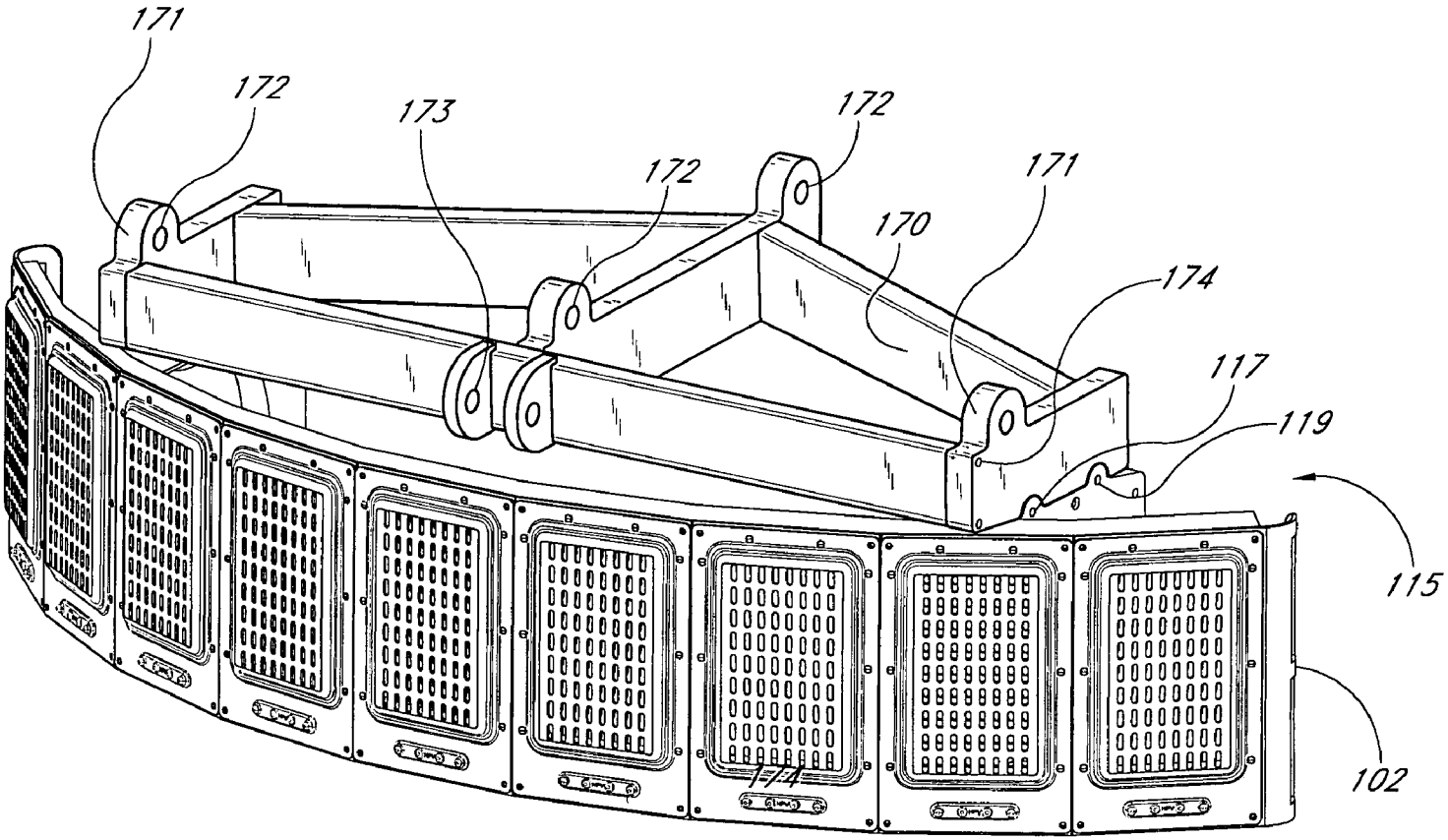
FIG. 7B illustrates in an isometric view a vertically-splayable rack attached to a grid in reversed position.

With reference to FIGS. 7A and 7B, a grid 170 is shown that assists in the construction and proper deployment of the surface array 101. The grid 170 advantageously includes two end pieces 171, which preferably includes holes that generally align with the pivot hole 117 and the locking hole 119. The grid 170 may be attached to the top vertically-splayable rack 102 of a surface loudspeaker array 101 using the holes (not viewable) through the end pieces 171, which are aligned with the pivot holes 117 and locking holes 119 (or, in an alternative embodiment, the recessed pivot holes 118 and recessed locking holes 120) of the end members 115, as illustrated in FIGS. 7A and 7B.

In one preferred embodiment of the invention, the grid 170 may be attached to the top vertically-splayable rack 102 of a surface loudspeaker array 101 in a first orientation relative to the rack 102, as illustrated in FIG. 7A (note the location of the suspension points 173), or in a second orientation relative to the rack 102, as illustrated in FIG. 7B. This reversibility advantageously provides improved flexibility in mounting configurations. Further, depending upon the orientation, the entire array 101 can be tilted from about 15° forward to about 45° backward. Other ranges of array tilting can be used.

The grid 170 advantageously includes a plurality of suspension points 172. In one preferred embodiment, the suspension points 172 preferably are disposed in a triangle, as illustrated in FIGS. 7A and 7B, which allows improved stability and facilitates proper positioning when hung. In a preferred embodiment, when the grid 170 is attached to the rack 102 in the first orientation, the grid 170 provides at least one of the plurality of the suspension points 172 in front of the center of gravity of the surface loudspeaker array 101, and when the grid 170 is attached to the rack 102 in the second orientation, the grid 170 provides at least one of the plurality of the suspension points 172 behind the center of gravity of the surface loudspeaker array 101. Thus, the orientation of the grid 170 can be selected to provide attachment points in convenient places depending on the desired orientation of the surface array 101 once deployed.

With reference again to FIG. 1B, a tensioning device 180, such as a strap, rope, cord, banding, tie rod or the like, can be attached from a point on the grid 170 to a bar 190 attached to a lower part of the surface array 101. The tensioning device 180 should be connected in a manner that secures the array 101 against substantial movement that would result in the splaying angle collapsing. Thus, the grid 170 advantageously includes a plurality of grid rear strap attachment points 173 as shown in FIGS. 7A and 7B. The grid rear strap attachment points 173 preferably are adapted to engage a tension device 180. Although in many desired orientations the individual vertically-splayable racks 102 of the surface array 101 will deploy automatically to the full vertical splay angle desired, in other orientations a tension device 180 is attached to the grid 170 to pull the vertically-splayable racks 102 into their fully-deployed position.

With continued reference to FIGS. 7A and 7B, the grid 170 preferably includes at least two grid rear strap attachment points 173, such that whether the grid 170 is attached to the surface loudspeaker array 101 in either the first orientation or in the second orientation, at least one of the grid rear strap attachment points 173 is disposed toward the rear face of the surface loudspeaker array 101. The grid 170 also advantageously includes a plurality of bar attachment holes 174, as also shown in FIGS. 7A and 7B.

Figure 8:
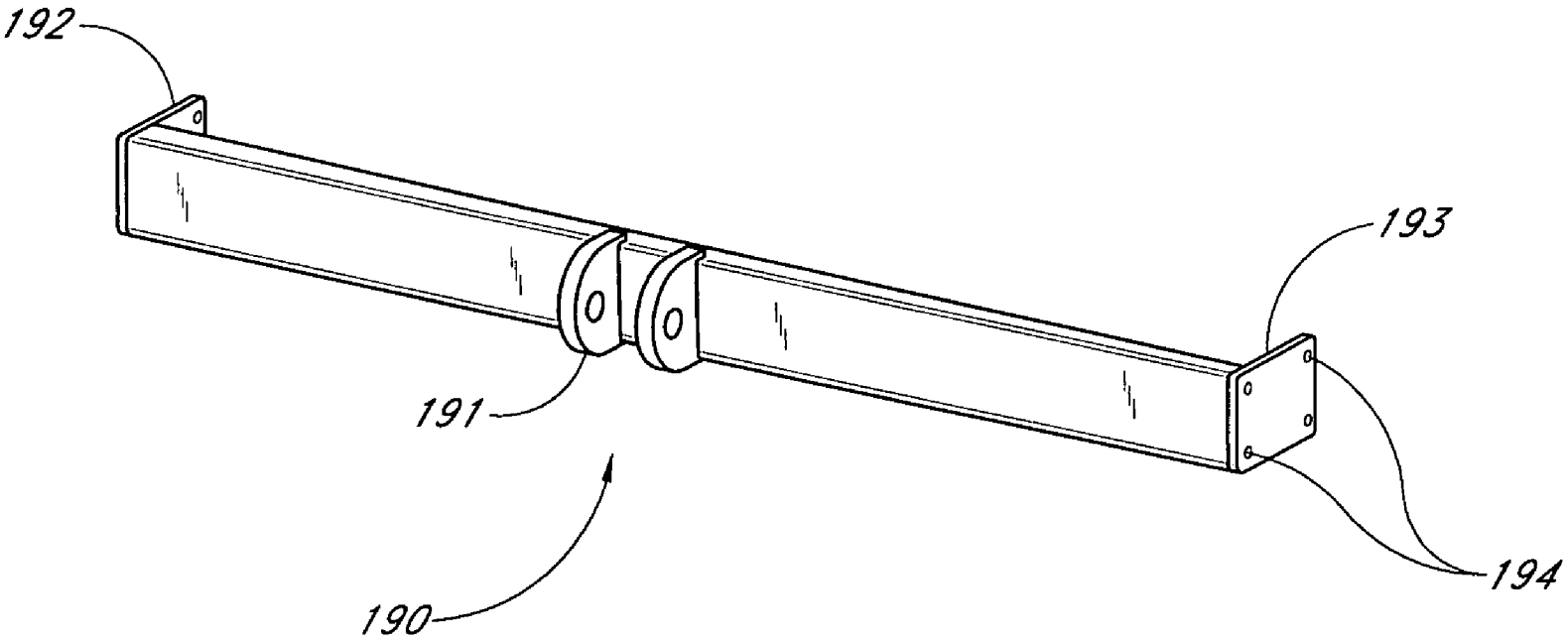
FIG. 8 illustrates in an isometric view more detail of the bar shown in FIG. 1B.

With reference now to FIG. 8, the bar 190, which was discussed above, advantageously includes at least one bar rear strap attachment point 191 that is adapted to engage the tension device 180. Thus, when the grid 170 is attached to the top of the surface array 101, the bar 190 can be attached either to the bottom or to another part of the surface array 101, and the tension device can then be attached between them to force the vertically-splayable racks 102 to deploy substantially as desired.

It is advantageous that the bar 190 be adapted to attach to the grid 170 or to any of the end members 115 of the vertically-splayable racks 102 using a plurality of bar connecting hardware 195, not illustrated. A plurality of bar connecting hardware 195 is inserted through a plurality of bar end holes 194 in the opposing ends 192 and 193 of the bar 190 and also through a plurality of the rib end holes 116 of the end member 115. The bar 190 is advantageously designed such that when the bar 190 is attached to the end member 115 of the vertically-splayable rack 102, the bar rear strap attachment point 191 is easily accessible.

The tension device 180 illustrated in FIG. 1B may in one embodiment include a first end portion 181 and a second end portion 182. The first and second end portions 181 and 182 of the tension device 180 can be designed to be attachable to the bar rear strap attachment point 191 and the grid rear strap attachment points 173. It is preferable that each of the first and second end portions 181 and 182 of the tension device 180 be designed to be attachable either to the bar rear strap attachment point 191 or to the grid rear strap attachment point 173. In another embodiment, the tension device 180 could be designed such that the first end portion 181 would attach only to one of either the bar rear strap attachment point 191 or the grid rear strap attachment point 173, and second end portion 182 could be similarly designed.

The tension device 180 may be attached to the bar rear strap attachment point 191 and to the grid rear strap attachment point 173 in any suitable manner. In one embodiment (not illustrated), the first and second end portions 181 and 182 of the tension device 180 may each include a hook portion. In another embodiment, one or both of the first and second end portions 181 and 182 of the tension device 180 may include a loop portion. Various tensioning configurations also can be used, including but not limited to a come along type of arrangement (not shown).

Figure 9A:
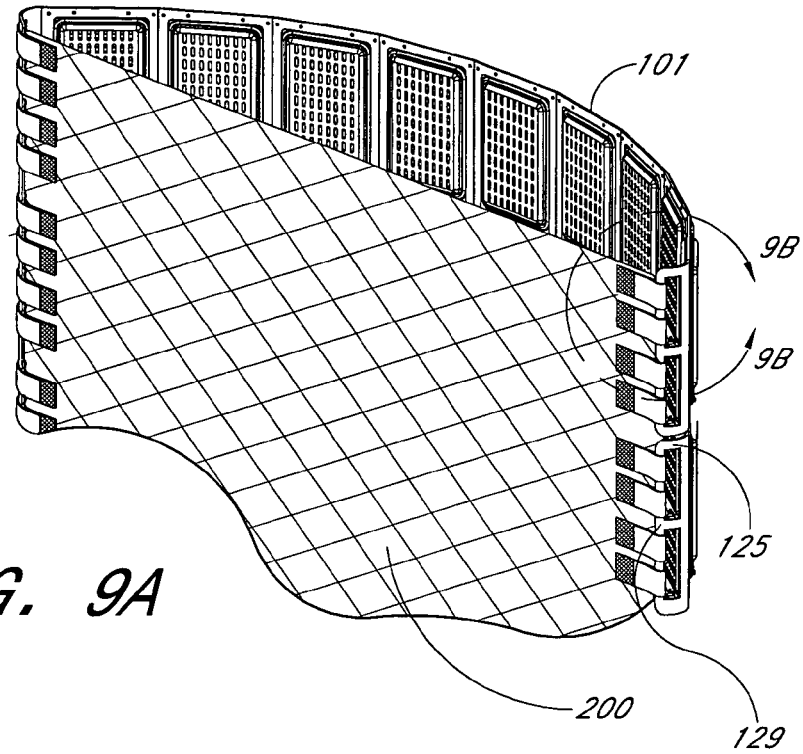
FIG. 9A illustrates in an isometric view the rear of a surface array with an acoustical blanket attached.
Figure 9B:
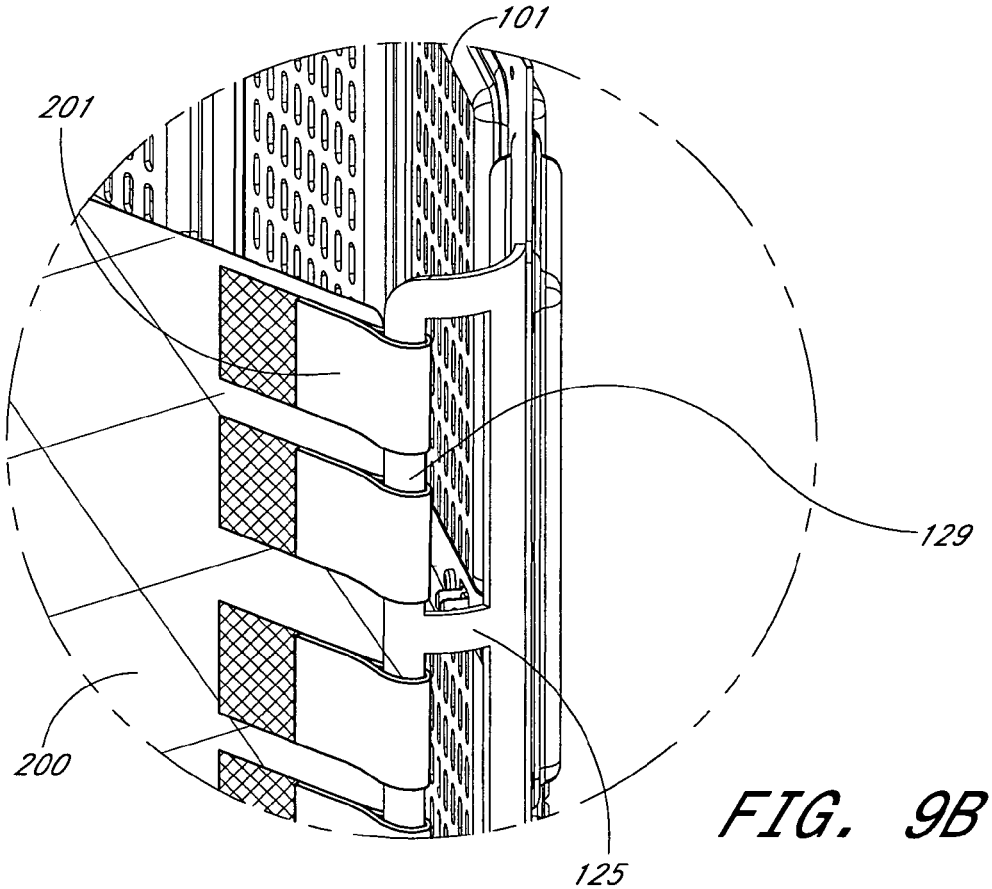
FIG. 9B illustrates in an isometric view one method of attaching an acoustical blanket to the rear of a flat panel surface array.

With reference to FIGS. 9A and 9B, a plurality of acoustical blankets 200 can be placed over one face of the surface array 101 to control rear sound radiation. When acoustical blankets 200 are placed across one face of the surface array 101, they absorb sound propagating from that face of the array, thus allowing the sound designer more control. Each of the acoustical blankets 200 is advantageously adapted for simple attachment and removal from the array 101. In one preferred embodiment, the acoustical blankets 200 are advantageously attached to the baffle 125 using a plurality of acoustical blanket attachment portions 129. In the illustrated embodiment shown in FIGS. 9A and 9B, the baffle 125 includes four acoustical blanket attachment portions 129, two at each end of the baffle 125. In other embodiments (not illustrated), the baffle 125 may include different numbers and placements of acoustical blanket attachment portions 129. As illustrated in FIGS. 9A and 9B, in one preferred embodiment the acoustical blanket 200 includes a plurality of straps 201 designed to attach to the illustrated acoustical blanket attachment portions 129. The acoustical blanket 200 could be attached using buttons, Velcro, snaps, laces, hooks, any combination thereof, or any of other various well-known and suitable means for attachment.

The surface loudspeaker array 101 may be suspended from the grid suspension points 172 in either the locked, non-vertically splayed position, one embodiment of which is illustrated in FIG. 1A, or in the unlocked, vertically splayed position, one embodiment of which is illustrated in FIG. 1B. FIG. 1B illustrates one embodiment of the surface loudspeaker array 101 suspended in the unlocked, vertically splayed position. The tension device 180 is attached to the bar rear strap attachment point 191 and the grid rear strap attachment point 173. In another embodiment (not illustrated), the surface loudspeaker array 101 could be suspended not only from the grid suspension points 172 but also from a bar suspension point on the bar 190. In either embodiment, tightening the tension device 180 ensures that the vertically-splayable racks are vertically splayed substantially to the angle pre-set using the splay angle control slots 163 on the cam 161.

In accordance with one aspect of the present invention, which is not necessarily found in all embodiments of the invention, the surface loudspeaker array 101 can be deployed using an extremely simple method. A surface loudspeaker array can transported in multiple pieces in wheeled cases. The wheeled cases advantageously may include a bottom wheeled portion and an upper cover portion. The first wheeled case can be rolled to an appropriate spot, and the upper cover portion can be removed, revealing a first surface loudspeaker array. A grid can be attached to the top of the first surface loudspeaker array, and the first surface loudspeaker array is then suspended from the grid suspension points. The first surface loudspeaker array is then lifted into the air, the bottom portion of the first wheeled case is removed. A second wheeled case then is rolled underneath the hanging first surface loudspeaker array. The upper cover portion of the second wheeled case is removed, revealing a second surface array. Then the top of the second surface loudspeaker array then is attached to the bottom of the first surface array using rack attachment hardware and, if vertical splaying is desired, cams. These steps may be repeated as often as necessary to create the size surface array desired. A bar may be attached to the surface array in any suitable location, and a tension device, such as a strap, may then be attached from the grid to the bar and tightened, thus forcing the surface array to splay vertically fully to the pre-set vertical splay angles. The fully assembled array then can be fully elevated to a desired location.

Similarly, in another method, sub-arrays can be configured of a number of racks. The sub-arrays can comprise any number of racks 102. In one preferred embodiment, the sub-arrays comprise four racks 102 with each rack 102 comprising 9 PMT 150. The sub-arrays can be packed within a wheeled case such that one sub-array is positioned in one wheeled case. The wheeled cases are commonly referred to as road cases. In one particularly preferred embodiment, the dimensions of the road case are approximately 17 inches by 46 inches by 50-½ inches, which accommodates the 4 racks with 9 PMT described above. In one embodiment, the array 101 is constructed such that it forms a portion of the case, while, in another embodiment, the array 101 can be lifted from inside a separate case. The sub-arrays can be connected together in the manner set forth above. In other words, a first preassembled sub-array can be elevated and a second preassembled sub-array can be secured to the first preassembled sub-array such that the size of the array can be increased in a rapid manner.

The terms and expressions that have been employed within this specification are used as terms of description and not of limitation. There is no intention in the use of such terms and expressions of excluding any equivalents of the features shown and described or portions thereof. Instead, it is recognized that various modifications are possible within the scope of the invention claimed. At times modifications of or alternatives to certain features have been explicitly described. The descriptions of modifications or alternatives for some features should not be read to exclude other modifications or alternatives not so described, nor should the lack of description of modifications or alternatives for other features be read to exclude such. Accordingly, not all of the features, aspects, and/or advantages are necessarily required to practice the present invention, and therefore the scope of the present invention should not be limited by the descriptions included within this specification.

What is claimed is:

1. A surface loudspeaker array comprising a plurality of vertically-splayable speaker racks that are connected together vertically in a serial manner, each said vertically-splayable speaker racks comprises a plurality of planar magnetic transducers or flat panel speakers, wherein at least one of said vertically-splayable speaker racks comprises a rib, a baffle secured to said rib, and a plurality of planar magnetic transducers or flat panel speakers secured to said baffle.

2. A surface loudspeaker array as recited in claim 1, wherein insulating material is interposed between said rib and said baffle.

3. A surface loudspeaker array as recited in claim 1, wherein insulating material is interposed between said baffle and said planar magnetic transducers or flat panel speakers.

4. A surface loudspeaker array as recited in claim 1, wherein said rib comprises a plurality of end members, said end members being adapted to allow vertical splaying of said vertically-splayable speaker racks.

* * * * *